US005953760A

United States Patent [19]

Powell

[11] Patent Number: 5,953,760

[45] Date of Patent: Sep. 21, 1999

[54] CURVED VISOR MECHANISM FOR HELMETS WITH LATERALLY MOVEABLE VISORS

[75] Inventor: Robert F. Powell, San Diego, Calif.

[73] Assignee: Tricel Corporation, San Diego, Calif.

[21] Appl. No.: 08/711,542

[22] Filed: Sep. 10, 1996

[51] Int. Cl.[6] ..... A42B 3/22

[52] U.S. Cl. ..... 2/424; 2/10

[58] Field of Search ..... 2/410, 6.3, 6.4, 2/6.5, 6.7, 424, 15, 10, 9, 422, 425, 411

[56] References Cited

U.S. PATENT DOCUMENTS

| | | | |
|---|---|---|---|
| 4,100,619 | 7/1978 | Piech et al. | 2/10 |
| 4,495,657 | 1/1985 | Bay | 2/424 |
| 4,945,573 | 8/1990 | Landis | 2/9 |
| 5,091,997 | 3/1992 | Foehl | 2/424 |
| 5,163,185 | 11/1992 | Hodnett | 2/424 |
| 5,477,566 | 12/1995 | Massman | 2/424 |

FOREIGN PATENT DOCUMENTS

| | | |
|---|---|---|
| 2281733 | 3/1976 | France . |
| 2339353 | 8/1977 | France . |
| 8110871 | 3/1982 | Germany . |
| 7602572 | 5/1985 | Germany . |
| 2115685 | 9/1983 | United Kingdom . |

*Primary Examiner*—Michael A. Neas

*Attorney, Agent, or Firm*—Knobbe, Martens, Olson & Bear, LLP

[57] ABSTRACT

A curved visor mechanism for helmets with laterally moveable visors that move on guides that define a track attached to the helmet. The visors are curved in the shape of a sector of an annulus of a circle. Using such a shape allows the track defined by the visors to maintain a nonzero rake angle at the front of the face area of the helmet, while preventing retracted visors from extending too close to the bottom of the back of the helmet. Removal of the visors from the helmet is accomplished by removing sections of the guides in which the visors move, preferably at the front of the helmet. This creates notches in the guides through which a visor can easily be inserted into and out of the helmet.

25 Claims, 8 Drawing Sheets

CURVED VISOR MECHANISM FOR HELMETS WITH LATERALLY MOVEABLE VISORS

BACKGROUND OF THE INVENTION

Helmets with laterally moveable visors are known in the art. In these helmets one or more visors are inserted into guides within the helmet, allowing for sideways movement in and out of a facial area. When not in the facial area, visors are stored in retracted positions within the helmet. Movement is accomplished by gripping tabs that are attached to the visors. In an embodiment with two visors, the wearer is able to switch visors simultaneously merely by moving one visor into the facial area while moving another out of the facial area and into the retracted position. This allows the wearer to switch from a clear to tinted visor, for example, while keeping the facial area covered. Unlike pivoted vertically raised visors, laterally moveable visors have the advantage of minimizing the risk of neck fatigue. When a pivoted vertically moving visor is raised while riding, the lower edge of the visor contacts the wind to create a change in the wind force. Because the wind force on laterally moveable visors remains substantially constant when visors are changed, there is a reduced chance that fatigue to neck muscles will occur. A further advantage of laterally moveable visors is the protection that the helmet gives to the visors when they occupy their retracted positions within the helmet.

Helmets with laterally moveable visors such as described above are disclosed in U.S. Pat. No. 5,477,566 to Massman, French Patent 2,281,733; French Patent 2,339,353, U.S. Pat. No. 4,100,619, and German Patent No. 7,602,572. In the Massman patent, the visors that move in and out of the facial area are known as straight visors, because they form a rectangular shape when laid out flat. To fit within the contours of the helmet, the visors are curved to form part of a generally cylindrical surface, where the longer edges of the rectangular visor form the top and bottom edges of this generally cylindrical surface. The dimensions of the visor are such that the visor can provide substantial coverage to the facial area. The visors move on upper and lower guides, which, because of the use of straight visors, define a generally cylindrical track that extends substantially around the helmet. At the front-center of the helmet, there is a nonzero rake angle between the vertical and the inclined surface of a visor positioned in the facial area. Thus, there is a tendency for the lower guides of the generally cylindrical track, and therefore the retracted visors, to be located near or below the bottom of the helmet in the back of the neck.

A further problem of helmets with laterally moveable visors involves the removal of the visors from the helmet. In the Massman patent, visor removal is accomplished by incorporating the visors and the guides into a visor cartridge. Then, after removing the entire cartridge from the helmet the visors themselves can be removed from the cartridge. This mechanism for visor removal has the disadvantage of requiring replacement of both visors even if one is still good, unless the visors are sold separately. In addition, this mechanism for visor removal is time-consuming and cumbersome.

Consequently, what is needed in the art is a helmet with laterally moveable visors, where the visors do not extend near the bottom rear portion of the helmet when they occupy their retracted positions. Also, it would be an improvement in the art to provide a mechanism in which visors can be easily removed from the helmet.

SUMMARY OF THE INVENTION

The present invention discloses a helmet with laterally moveable visors in which the retracted visors and the guides on which these visors move remain a substantial distance from the bottom of the back of the helmet. According to this invention, curved rather than straight visors are used, where the curved visors when laid flat are in the shape of a sector of an annulus of a circle. Thus, the top and bottom edges of the visor are curved, not straight. Using this shape allows for visors in the face area to be tilted at a nonzero rake angle, while ensuring that the lower edge of the retracted visors does not extend too near to the bottom of the back of the helmet. The present invention also discloses a removable visor assembly in which a portion of each guide, preferably at the front of the helmet, is removable to allow a visor to be easily inserted into and out of the helmet. In the discussion that follows, the area in space which the visor occupies and through which the visor moves will be referred to as the "extent" of the visor. Thus, the visor surface extent constitutes the path in space occupied by the surface of the visor and through which the visor moves.

DETAILED DESCRIPTION OF THE PREFERRED EMBODIMENTS

Figure 1:
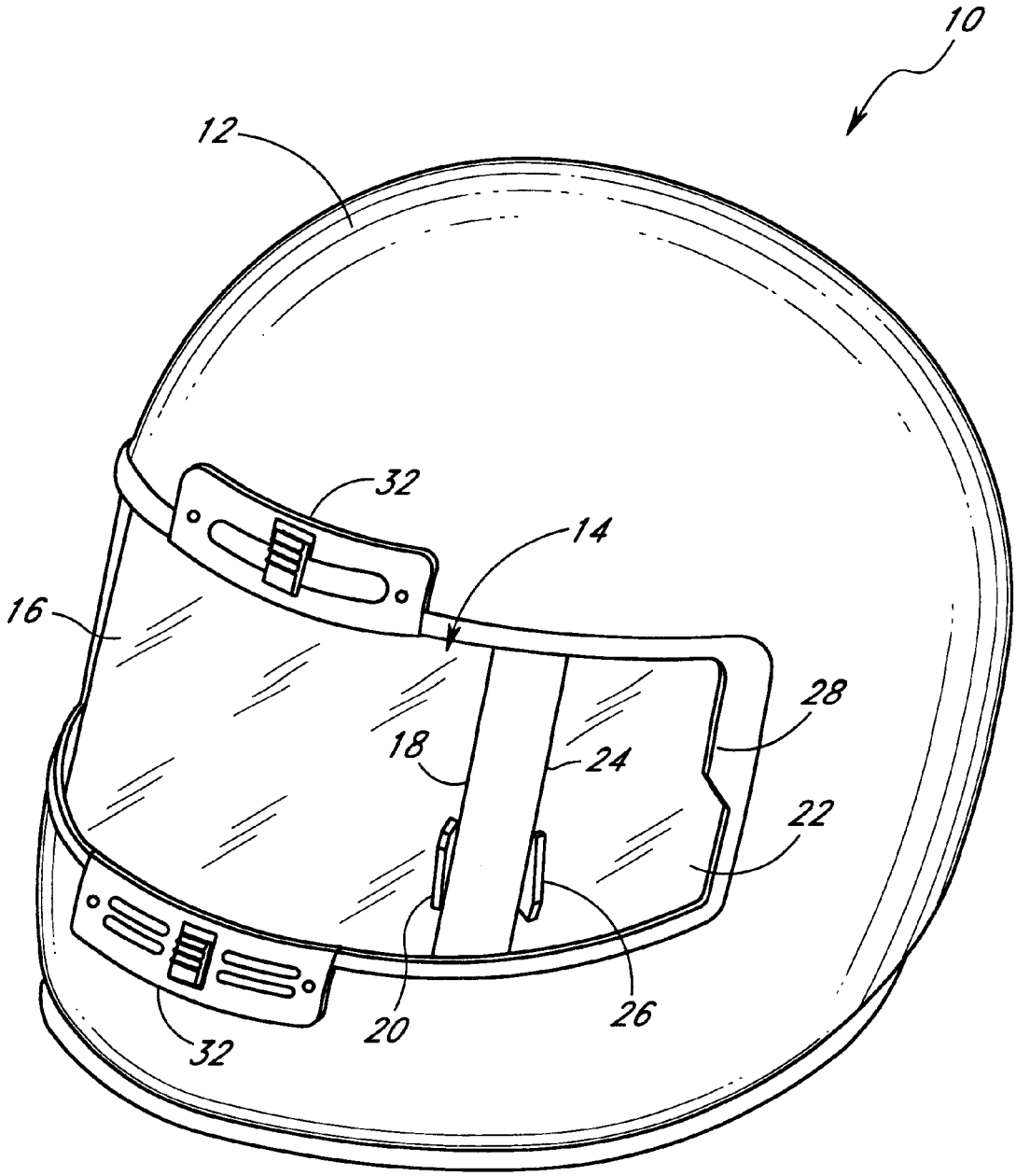
FIG. 1 is a perspective view of a helmet according to the invention.

FIG. 1 shows a helmet 10 having a hard casing 12 used to wrap around and protect a human head. In a facial area 14 surrounded by a border 28, a clear visor 16 is shown, adjacent to a tinted visor 22. Air intake covers 32 are also shown. Three configurations are possible with these visors. First, the facial area 14 may remain completely exposed. To accomplish this, the wearer grips tab 20 of the clear visor and pushes the tab in a clockwise direction when viewing the helmet from above until the tab contacts the border 28 (not shown). Similarly, to retract the tinted visor, the wearer grips tab 26 and pushes it in a counter-clockwise direction until the tab contacts the opposing border 28. Second, the facial area may be substantially covered with the clear visor. From a configuration with the facial area completely exposed, the wearer simply grips the tab 20 and moves it in a counter-clockwise direction to pull the clear visor out of its retracted position. Movement stops when the edge 18 of the clear visor 16 contacts the edge 24 of the tinted visor 22, wherein the tinted visor 22 occupies a retracted position within the helmet. From this configuration, a third configuration may be achieved with the tinted visor covering the facial area. By gripping tab 26, or both tabs 20 and 26 simultaneously, the wearer moves both visors in a clockwise direction until tab 26 contacts the border 28. Movement of the tinted visor into an exposed facial area, and movement of a clear visor into a facial area currently occupied by the tinted visor, are accomplished by similar mechanisms to the ones described above.

Figure 2A:
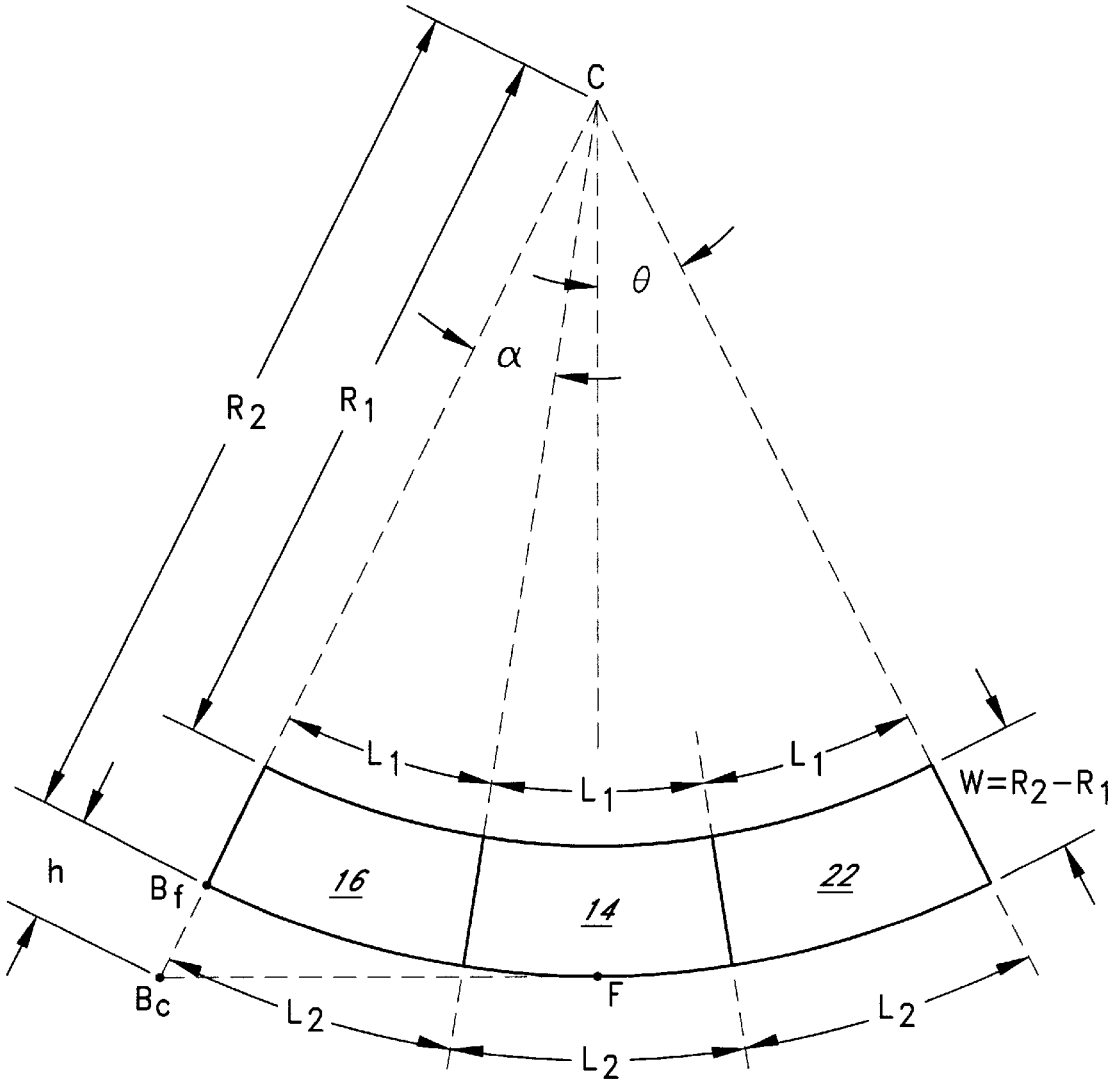
FIG. 2*a* is a two dimensional plan view of the surface extent of one or more visors when laid flat.

FIG. 2*a* shows the visor surface extent when laid flat. This area is a sector of an annulus of a circle whose three equal sub-sectors are the space occupied by the clear visor 16 when retracted, the tinted visor 22 when retracted, and the open space 14 between them denoting the position of a visor when it occupies the facial area. The upper edge of each visor has a length $L_1$, and the lower edge of each visor has a length $L_2$. The visors are curved along these edges in the following manner. The upper edge of each visor forms an arc of a circle with radius $R_1$ and center C. The lower edge of each visor forms an arc of a larger circle with the same center C and a radius $R_2$. The left and right edges of each visor are spaced apart at an angle $\alpha$. The width W of the visors 16 and 22 remains constant at a value equal to $R_2-R_1$.

Figure 2B:
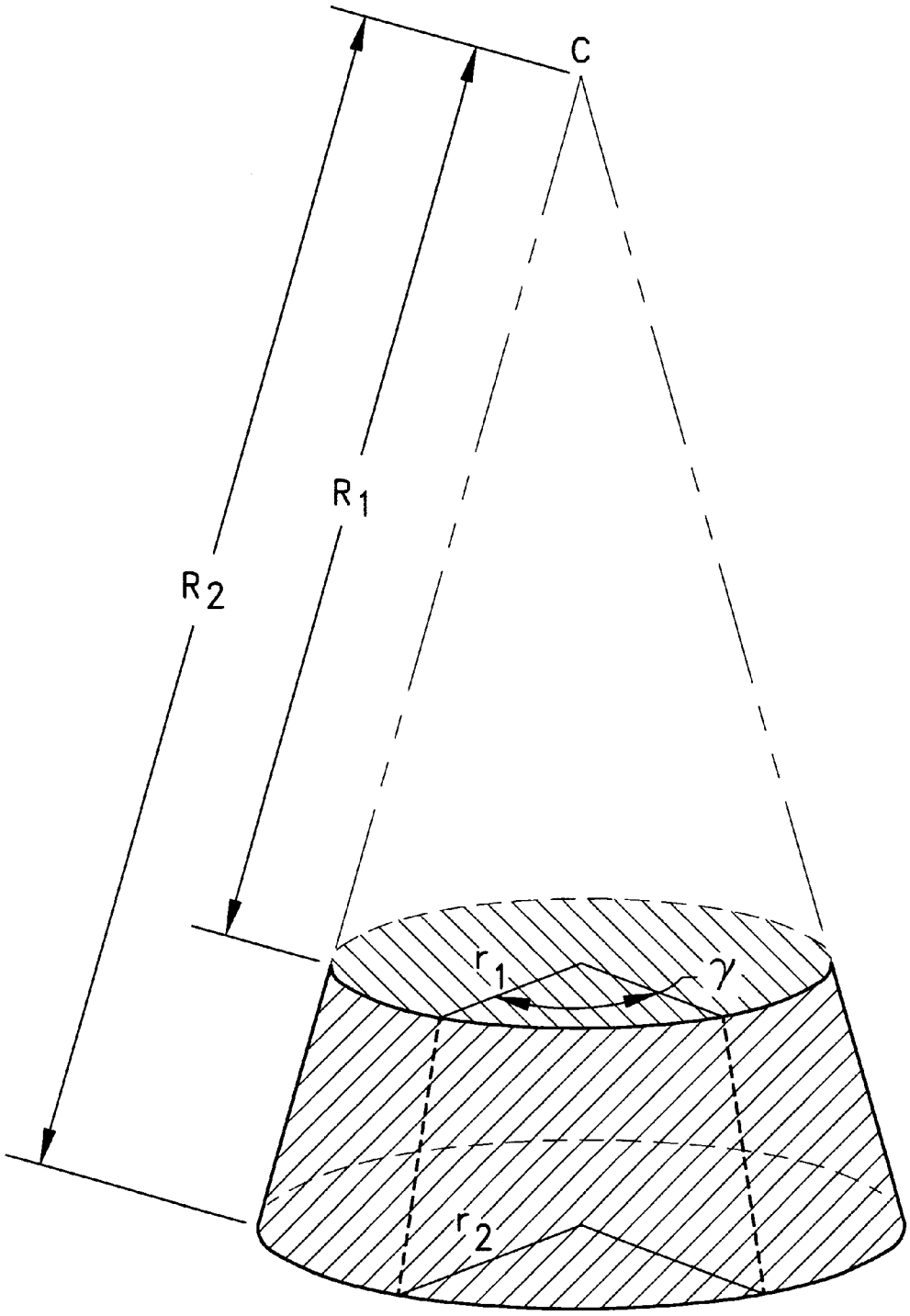
FIG. 2*b* is a perspective view of the visor surface extent when in the shape of a frustum of a cone.

Alternatively, the shape of the visors 16 and 22 can be described using the schematic shown in FIG. 2*b*. FIG. 2*b* shows a right circular cone with apex C, generatrix $R_2$, and base radius $r_2$. A frustum of the cone is defined by the hatched area in FIG. 2*b*, where $R_1$ is the generatrix of a cone with radius $r_1$. The visor shape can be determined by taking the conical surface of the frustum of the cone and laying it flat. This will produce a shape similar to that shown in FIG. 2*a*. Thus, portions of the surface can be cut in order to produce the desired visor dimension. An example of how a visor might be cut from the frustum of a cone is shown by the dotted lines and angle $\gamma$ in FIG. 2*b*.

Figure 3:
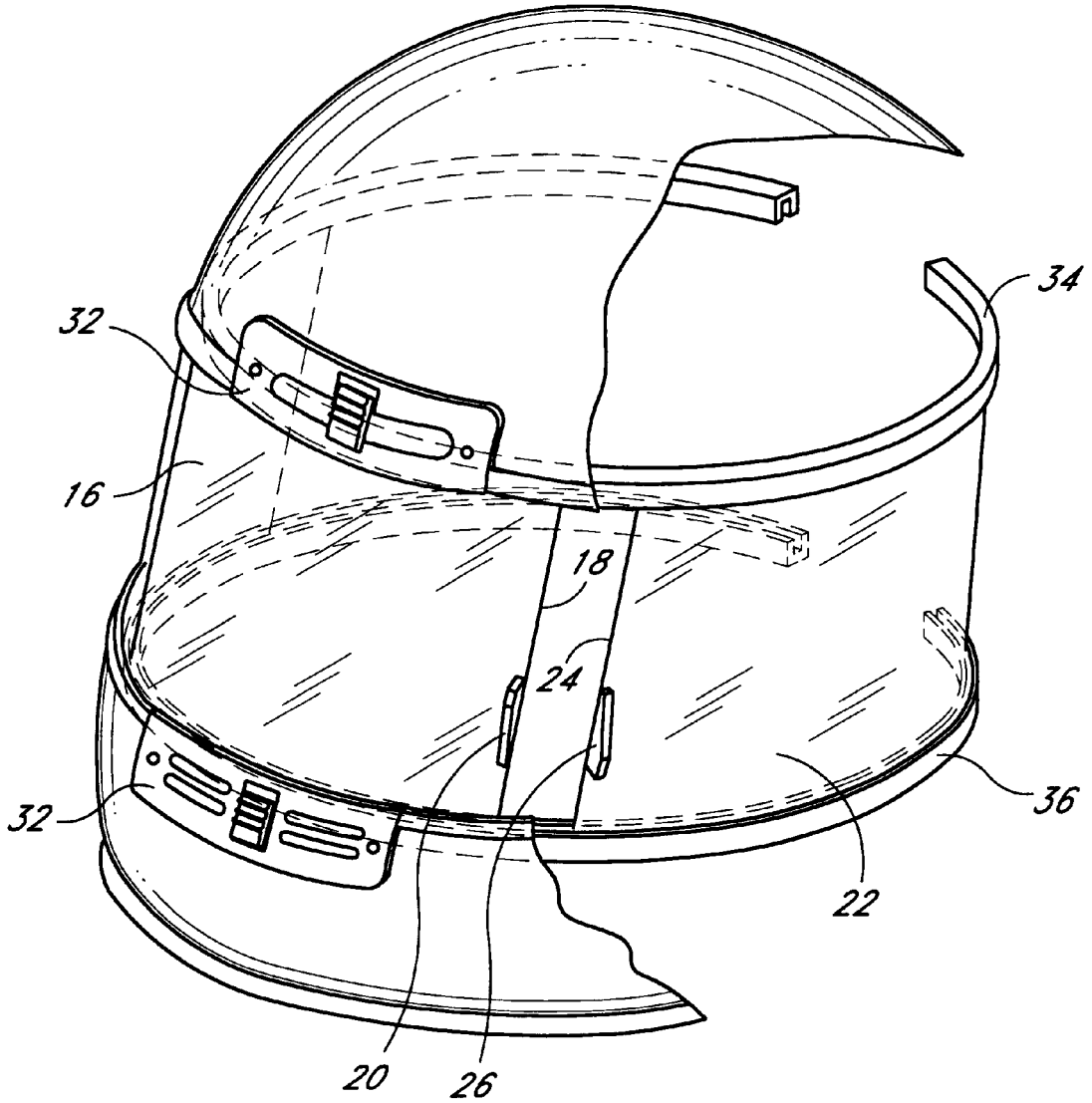
FIG. 3 is a perspective view of the helmet of FIG. 1, with a portion thereof removed to reveal the visors contained in the helmet.

FIG. 3 shows the guide mechanism for laterally moving the curved visors described in FIG. 2 within the helmet. The curved visors 16 and 22 are mounted between guides 34 and 36, which are located on the interior surface of the helmet. These guides outline a generally elliptical shape extending substantially around the interior surface of the helmet. Together, the guides 34 and 36 generally define a visor surface extent in which the visors can be located within the helmet. In this embodiment, the retracted visors do not extend all the way to the back of the helmet, and the visor surface extent is discontinuous at the rear of the helmet. Air intake covers 32 are also shown.

Figure 4:
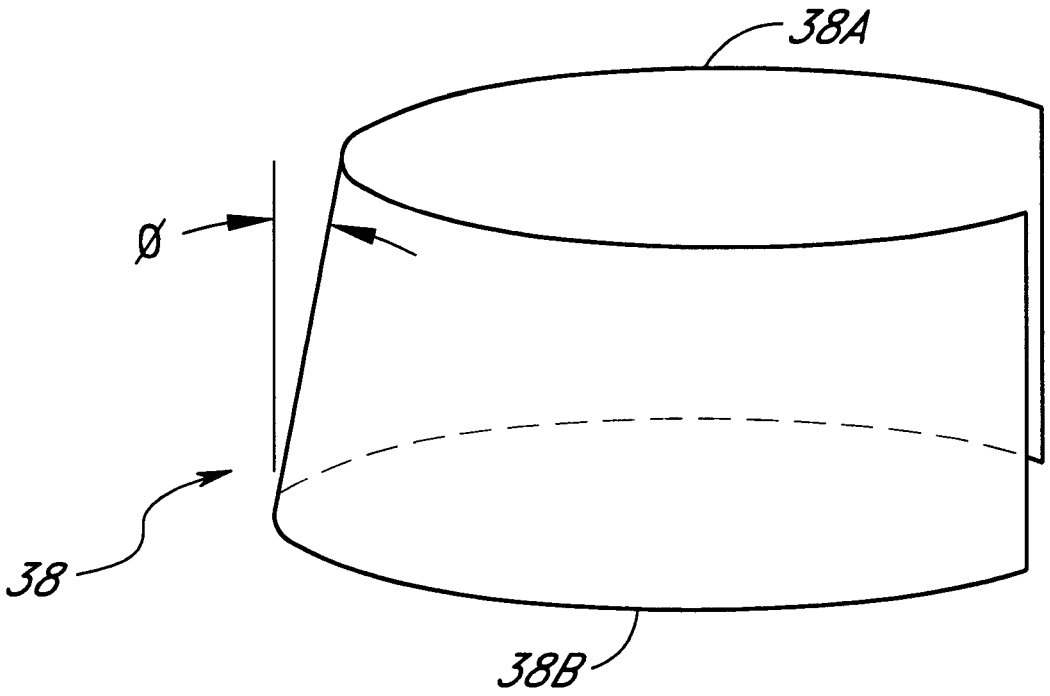
FIG. 4 is a side view of a visor surface extent describing a discontinuous path in the helmet.

FIG. 4 shows a side view of visor surface extent 38. Because the visors have circular curvature, the generally elliptical edges 38A and 38B of the visor surface extent are not located within a plane, but rather are curved in the general manner shown in the figure. At the front-center of the helmet 10 in the facial area 14, visor surface extent 38 is positioned at a nonzero rake angle $\phi$ with respect to the vertical. Near the back of the helmet, guide 36 remains a substantial distance from the bottom of the helmet. This is because the use of curved visors enables visor surface extent 38 to curve upward and away from the bottom of the rear of the helmet.

Figure 5:
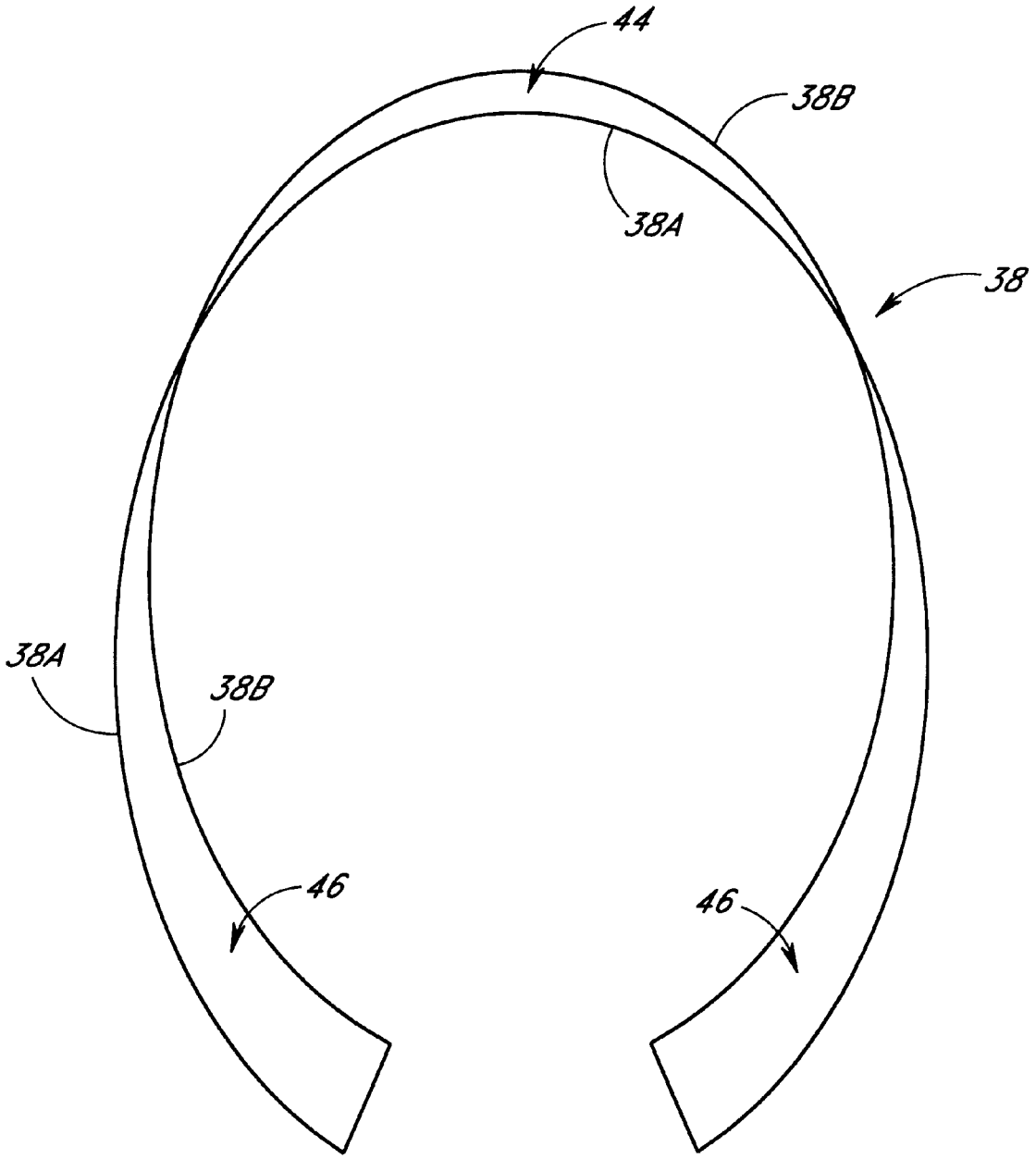
FIG. 5 is an above perspective of a discontinuous visor surface extent.

FIG. 5 shows an above perspective of visor surface extent 38 to better represent the generally elliptical shapes of the edges 38*a* and 38*b*. The elliptical shapes are necessary to conform to the shape of the helmet, which is shaped in order to accommodate a generally elliptical human head. At the rear of the helmet, the discontinuity of visor surface extent 38 is shown. With this discontinuity, the guides can be positioned to better conform to the contours of the interior surface of the helmet. More specifically, by using a discontinuous area, the rake angle $\phi$ can change significantly around the interior of the helmet. In area 44 of surface extent 38 in FIG. 5, $\phi$ is positive, so from an above perspective we see the outer part of surface extent 38. In areas 46 of surface extent 38, $\phi$ is negative, and we see the inner part of surface extent 38. The use of a discontinuous surface extent 38 may also be advantageous when the visors are longer than one-third the circumference of the helmet. In this situation, surface extent 38 may overlap in the rear of the helmet to accommodate the excessive length.

Although we have described a surface extent 38 which is discontinuous in the rear of the helmet, an alternative configuration may be used when the surface extent 38 extends completely around the interior surface of the helmet and connects in the rear. Such a configuration may, for example, be used where the length of each visor is substantially equal to one-third the circumference of the helmet.

To demonstrate the improvement of the present invention, we refer back to FIGS. 2*a* and 2*b* to approximate the distance that surface extent 38 is raised from the bottom of the rear of the helmet by using curved visors rather than straight visors. To do so, we assume that surface extent 38 is continuous in the general shape of the frustum of the right circular cone shown in FIG. 2*b*. Although the area will probably not have flat, circular bases as in this figure, this assumption is sufficient to approximate the effect of the curved visors. We further assume that the lengths of the visors $L_1$ and $L_2$ are equal to one-third the circumferences of the upper and lower bases of the frustum-shaped area, respectively. Then, the length $L_1$ of visors 16 and 22 will equal $2\pi r_1/3$, and the length $L_2$ of visors 16 and 22 will equal $2\pi r_2/3$. Line CF in FIG. 2*a* defines the front-center of the facial area 14 of the helmet, and $\theta$ measures the angle swept from the front-center of the facial area to the back of the helmet. At the bottom-center of the facial area, denoted as point F, a tangent $FB_c$ is shown, where point $B_c$ represents the location where straight visors meet when they are stored in a cylindrical area. The point $B_f$ represents the location where curved visors meet when they are stored in a frustum-shaped area. The distance between $B_c$ and $B_f$, denoted as h, represents the distance that the frustum-shaped area is raised with respect to the cylindrical area. Using the right triangle $CFB_c$, $$\cos\theta = R_2/(R_2+h).$$

Solving for h gives $$h = [R_2(1-\cos\theta)]/\cos\theta.$$

The angle $\theta$ is found from the ratio of the arc it sweeps to the circumference of the full circle with radius $R_2$. Thus, $$\theta = [(3L_2/2)/(2\pi R_2)]2\pi = 3L_2/2R_2,$$

and $$h = \{R_2[1-\cos(3L_2/2R_2)]\}/\cos(3L_2/2R_2).$$

Figure 6:
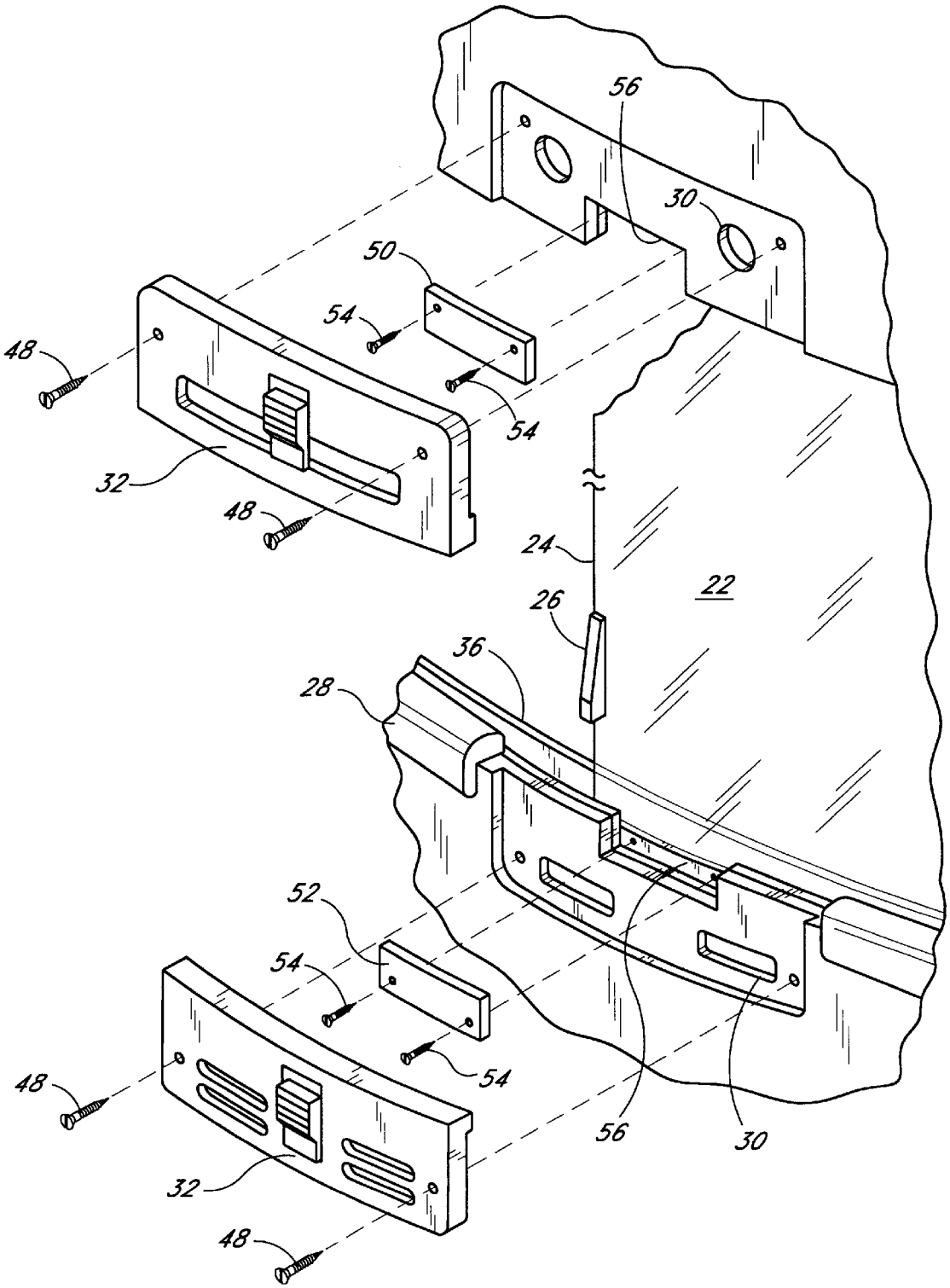
FIG. 6 is a partially cut away perspective view of a helmet and visor combination, illustrating the removable visor design.
Figure 7:
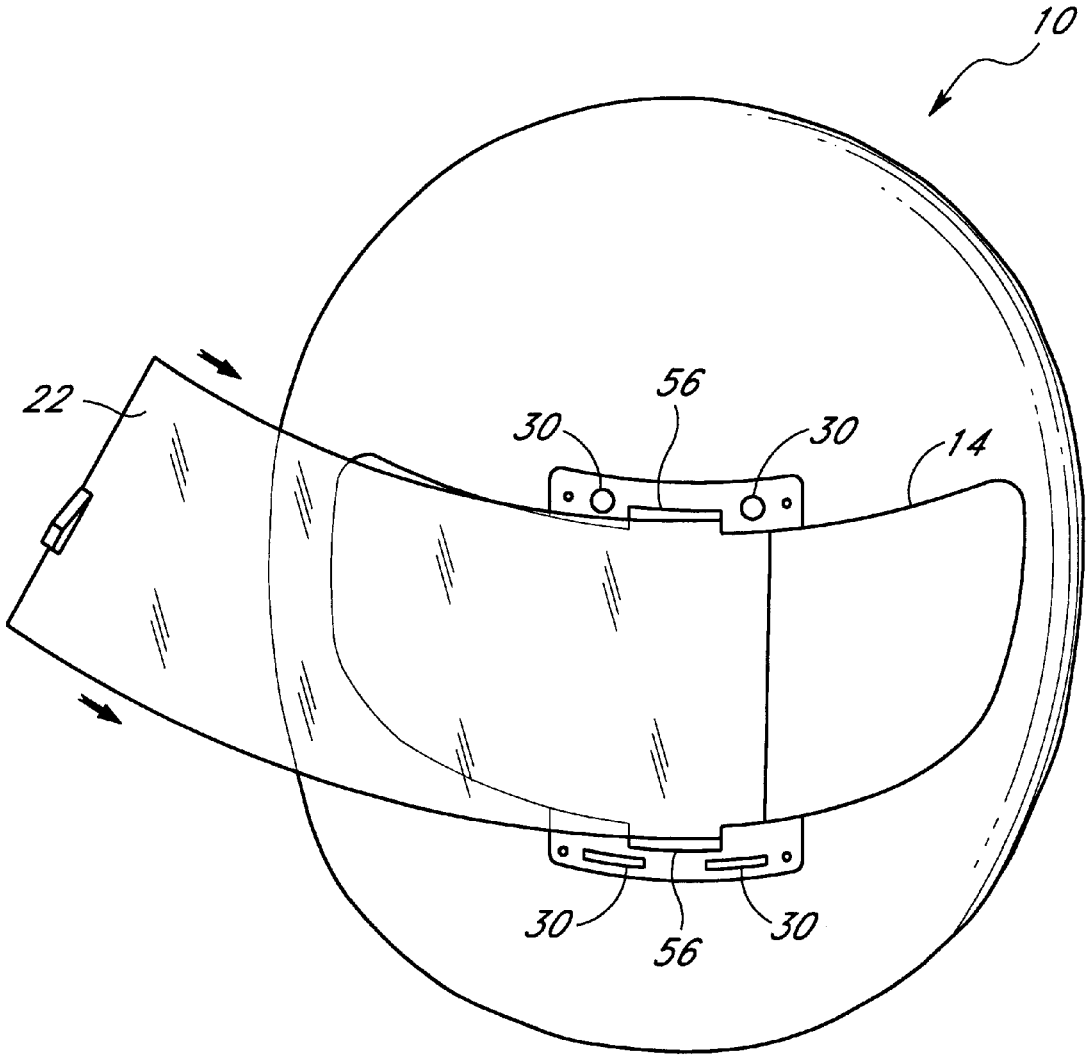
FIG. 7 is a front elevation view of the helmet, showing the insertion of a curved visor into the guides.

FIG. 6 shows the visor removal mechanism of the present invention. Air intake covers 32, which are located in positions that are readily accessible, such as above and below the facial area 14, are attached to the helmet using screws 48. These covers can easily be removed to reveal air vents 30 and the upper and lower guides 34 and 36. A portion 50 of the upper guide 34 and a portion 52 of the lower guide 36 can be removed from the center of the facial area by unscrewing screws 54 to reveal notches 56 in the guides. Through these notches a visor 16 or 22 can be inserted or removed from the helmet in the manner shown in FIG. 7. After a visor has been removed or inserted, the portions 50 and 52 can be reattached to the guides using the screws 54, and the air intake covers can be reattached to hide the visor removal mechanism.

Of course, numerous variations and modifications of the invention will become readily apparent to those skilled in the art. Accordingly, the scope of the invention should not be construed as limited to the specific embodiment depicted and described but rather, the scope is defined by the appended claims. The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A helmet and visor assembly, comprising:

a protective helmet adapted to cover at least a portion of the human head, said helmet having a facial opening, a front, a back, sides, a top, and a bottom;

a top guide and a bottom guide affixed to the helmet extending along said opening and around at least one side of said helmet, each of said guides generally describing at least a portion of an ellipse;

a visor mounted to said guides so as to be laterally moveable along said guides; said visor when laid flat forming a sector of an annulus of a circle.

2. The assembly according to claim 1, wherein said visor, when laid flat, has a top edge, a bottom edge, a left side edge and a right side edge, wherein said top edge forms an arc of length $L_1$ of a circle of radius $R_1$, the center of said circle being located in a direction away from said bottom edge, and said bottom edge forms an arc of length $L_2$ of a circle of radius $R_2$, said circle of radius $R_2$ having the same center as said circle of radius $R_1$, said radius $R_2$ being longer than said radius $R_1$.

3. The assembly according to claim 2 wherein said bottom guide extends substantially around the back of said helmet where it is spaced a distance h from the bottom of the helmet, wherein said distance h can be approximated as $\{R_2[1-\cos(3L_2/2R_2)]\}/\cos(3L_2/2R_2)$.

4. The assembly according to claim 3, wherein said distance h is at least 3 cm.

5. The assembly according to claim 1 wherein a rake angle at the front-center of said visor occupying said opening is greater than zero.

6. The assembly according to claim 1 wherein each of said guides is discontinuous.

7. The assembly according to claim 1 wherein said guides conform closely to the contours of said helmet.

8. The assembly according to claim 1 wherein each of said guides extends completely around said helmet.

9. The assembly according to claim 8 wherein said top and bottom guides together define a track having the general shape of at least a portion of a frustum of a cone.

10. The assembly according to claim 9 wherein said generally-shaped frustum is part of a right circular cone, which is flattened along its sides to form substantially elliptical bases that are not flat.

11. The assembly according to claim 1, wherein a portion of said top and bottom guides constitute separate pieces and are removable so that said visor can easily be inserted into and out of said guides.

12. The assembly according to claim 11 wherein the removable portions of said guides are covered by air intake covers.

13. The assembly according to claim 1 wherein the guides extend within the interior of the helmet.

14. The assembly according to claim 1 wherein the guides are integrated into said protective helmet.

15. The assembly according to claim 1 wherein said visor is tinted.

16. The assembly according to claim 1 wherein said visor has a gripping member for assistance in laterally moving the visor.

17. The assembly according to claim 1 wherein the guides extend into the back of the helmet and the visor is moveable along the guides into the back of the helmet.

18. The assembly according to claim 1 wherein a plurality of visors are associated with the guides.

19. The assembly according to claim 18 wherein only one of said plurality of visors covers the entire facial opening at a time.

20. The assembly according to claim 18 wherein at least one of the plurality of visors has a gripping member to assist in producing lateral movement of said at least one visor.

21. The assembly according to claim 18 wherein the plurality of visors have gripping members configured to assist in producing substantially simultaneous lateral movement of portions of at least 2 visors across the facial opening.

22. The assembly according to claim 18 wherein one of said visors is clear and another of said visors is tinted.

23. In a helmet and visor assembly in which the visor is mounted for lateral movement around at least a portion of the helmet along at least one guide, the improvement comprising a separate removable portion of said guide to allow for said visor to be easily inserted into and out of said guide.

24. A visor for helmets with laterally moveable visors, said visor being adapted to be mounted on guides affixed to said helmet, said visor when laid flat having a top edge, a bottom edge, a left side edge and a right side edge, wherein said top edge forms an arc of length $L_1$ of a circle of radius $R_1$, the center of said circle being located in a direction away from said bottom edge, and said bottom edge forms an arc of length $L_2$ of a circle of radius $R_2$, said circle of radius $R_2$ having the same center as said circle of radius $R_1$, said radius $R_2$ being longer than said radius $R_1$.

25. The visor of claim 24 wherein:

said left side edge is formed from a line connecting points on said circles of radii $R_1$ and $R_2$, said points being determined by a first radial component extending from the center of said circles and intersecting said circles; and said right side edge is formed from a second radial component extending from the center of said circles and intersecting said circles, said second radial component located at an angle $\alpha$ measured counterclockwise from said first radial component.

* * * * *